United States Patent [19]

Poag et al.

[11] Patent Number: 4,489,663

[45] Date of Patent: Dec. 25, 1984

[54] LIGHT WEIGHT VAULT DOOR

[75] Inventors: D. W. Poag, Ottawa; W. R. Merritt, Nepean, both of Canada

[73] Assignee: Canadian Patents & Development Limited, Ottawa, Canada

[21] Appl. No.: 403,052

[22] Filed: Jul. 29, 1982

[30] Foreign Application Priority Data

Sep. 16, 1981 [CA] Canada ..... 386021

[51] Int. Cl.[3] ..... E05G 1/026; E04B 2/02

[52] U.S. Cl. ..... 109/76; 109/82; 52/809

[58] Field of Search ..... 109/58, 64, 74, 76, 109/80, 82, 83; 49/501; 52/809

[56] References Cited

U.S. PATENT DOCUMENTS

| | | | |
|---|---|---|---|
| 2,970,347 | 2/1961 | Massopust | 49/501 |
| 3,156,975 | 11/1964 | Shaw | 52/809 X |
| 3,408,966 | 11/1968 | Gartner | 109/74 |
| 4,049,864 | 9/1977 | Hoover et al. | 109/82 X |
| 4,324,834 | 4/1982 | Page et al. | 52/404 X |

FOREIGN PATENT DOCUMENTS

| | | | |
|---|---|---|---|
| 1394918 | 3/1965 | France | 49/501 |
| 2320414 | 3/1977 | France | 49/501 |
| 1600247 | 10/1981 | United Kingdom | 109/82 |

*Primary Examiner*—Robert P. Swiatek
*Attorney, Agent, or Firm*—Robert G. Hendry

[57] ABSTRACT

This invention provides a panel for use in doors or walls of vaults or strong rooms which is lighter in weight than conventional materials while providing comparable attack resistance. The panel consists of a layer of ceramic tiles adhesively secured to an energy-absorbing backing layer. Both faces of the panel are covered by sheet metal, and when the panel is used in constructing a door, the edges of the door also have a suitable metallic covering.

3 Claims, 2 Drawing Figures

LIGHT WEIGHT VAULT DOOR

This invention relates to vaults or strong rooms and, more particularly, to panels for use in walls or door structures.

Known vaults rely on the density of materials to provide resistance to attack and thus extremely heavy doors consisting of several inches of steel are provided. Not only does the weight of conventional doors exceed the live load limits of conventional office floors but such a door can not be conveniently manhandled into position. It is, therefore, desirable to develop a panel or door constructed of lightweight materials which will have comparable attack resistance to punching, drilling and burning.

It is therefore an object of this invention to provide a vault panel or door which is lighter in weight than conventional panels or doors which will provide comparable attack resistance.

Accordingly, the present invention provides a door or panel for use in a vault, said panel comprising a layer of ceramic material backed by a solid energy-absorbing polymeric layer, and a metallic covering on at least the major faces of said panel.

Figure 1:
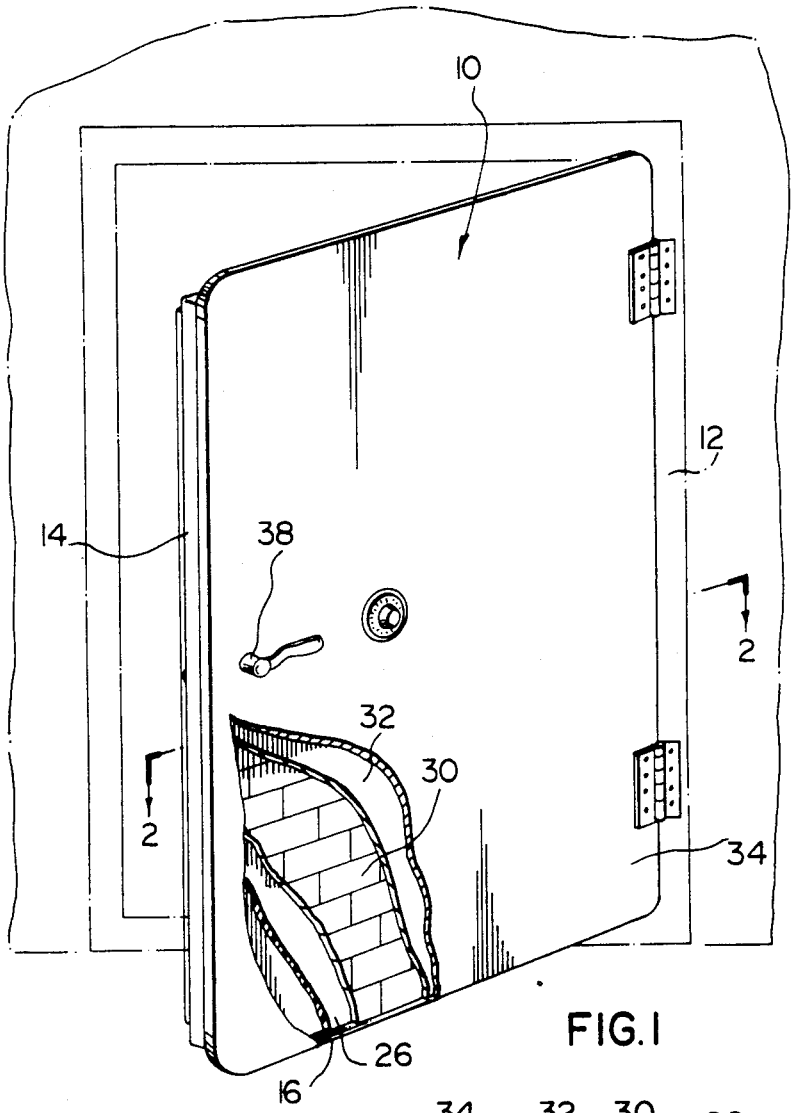
Figure 2:
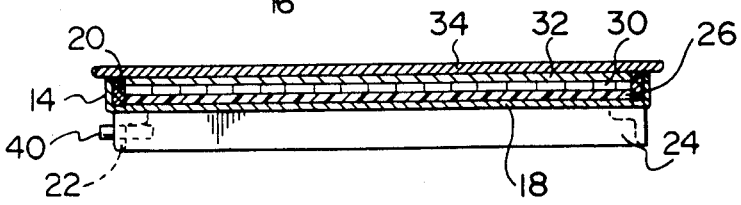

In the accompanying drawings, which illustrate a preferred embodiment of the invention;

FIG. 1 is a cutaway perspective view of a vault door in accordance with this invention, and FIG. 2 is an enlarged sectional view taken along the line 2—2 of FIG. 1.

Referring now in detail to the drawings in which a vault door shown generally at 10 is hingedly attached to a door frame 12, preferably of U-shaped cross section. The door 10 is fabricated by bending side edges 14 and end edges 16 of a rectangular sheet 18 of steel to form the bottom, top and sides of the door 10. Bars 20 are secured as by welding to the inside faces of the sides of the door. Vertically extending reinforcing members 22 and horizontal members 24, preferably of right angle cross section, are secured to the outer face of the metal sheet 18 adjacent to, but spaced from the side edges.

The core of the door 10 comprises a sheet 26 of dense energy absorbing polymeric material preferably a polycarbonate or acrylic which is adhesively secured to the inner face of the metal sheet 18. A suitable adhesive for use in this panel or door is Dow Corning Silastic 732 RTV. The next layer comprises individual ceramic tiles 30 arranged in staggered rows and adhesively secured to the acrylic or polycarbonate sheet 26. The preferred ceramic tiles 30, sold under the name Arlcite [trademark] comprise high purity aluminum oxide to provide resistance to thermal attack as well as drills and saw blades. In addition, the use of this silicon rubber type adhesive causes it to be time consuming to remove the tiles and it is difficult to break the tiles with a hammer because of the impact absorbing acryilic layer 26.

A sheet of aluminum or other material of high thermal conductivity 32 is adhesively secured to the face of the tiles 30 and to a metal sheet 34 forming the outer skin of the door or panel 10. The sheet 34 is welded to the side members 14 and 16 of the door 10.

Suitable apertures are provided in the door 10 to accommodate the door lock 38. Locking bolts 40 connected to the lock 38 in a conventional manner, extend through suitable apertures in the reinforcing member 22 to engage the door frame.

We claim:

1. A security vault having a door of reduced weight constructed and arranged to delay penetration when being illegally entered, said door comprising a plurality of layers in the order as follows:

an outer thin metal layer;

a sheet of metal having thermal conductivity higher than said outer metal layer adhesively secured to said outer metal layer;

a continuous layer of aluminum oxide tiles adhesively secured to said conductive metal layer, said tiles being disposed adjacent each other without gaps therebetween;

a layer of energy-absorbing polymeric material selected from the group consisting of polycarbonate and an acrylic polymer adhesively secured to said layer of aluminum oxide tiles with a hard silicone rubber, and an inner metallic layer adhesively secured to and covering said layer of energy-absorbing polymeric material; said layers being chosen and designed whereby said door is light in weight; wherein the energy-absorbing polymeric layer protects said ceramic layer from being penetrated by pounding, and said door cannot be penetrated with a signle tool, so as to delay illegal entry.

2. A vault as claimed in claim 1 wherein said polymeric material in said door is an acrylic polymer.

3. A vault as claimed in claim 1 wherein said polymeric material in said door is a polycarbonate resin.

* * * * *